US011852325B2

(12) United States Patent
Bai et al.

(10) Patent No.: US 11,852,325 B2
(45) Date of Patent: Dec. 26, 2023

(54) TRIPOD LAMP

(71) Applicant: NINGBO JINGHUI OPTO-ELECTRONIC CO., LTD., Zhejiang Province (CN)

(72) Inventors: Guohui Bai, Zhejiang Province (CN); Xia Xiao, Zhejiang Province (CN); Guohuan Feng, Zhejiang Province (CN)

(73) Assignee: NINGBO JINGHUI OPTO-ELECTRONIC CO., LTD., Zhejiang Province (CN)

( * ) Notice: Subject to any disclaimer, the term of this patent is extended or adjusted under 35 U.S.C. 154(b) by 0 days.

(21) Appl. No.: 17/845,657

(22) Filed: Jun. 21, 2022

(65) Prior Publication Data

US 2023/0296233 A1 Sep. 21, 2023

(30) Foreign Application Priority Data

Mar. 17, 2022 (CN) ..... 202210278711.X
Mar. 17, 2022 (CN) ..... 202220590816.4

(51) Int. Cl.
*F21V 21/22* (2006.01)
*F21V 21/14* (2006.01)

(52) U.S. Cl.
CPC ..... *F21V 21/22* (2013.01); *F21V 21/145* (2013.01)

(58) Field of Classification Search
CPC ..... F21V 21/12; F21V 21/22; F21V 21/145
See application file for complete search history.

(56) References Cited

U.S. PATENT DOCUMENTS

2019/0107270 A1* 4/2019 Harvey ..... F21V 17/007

FOREIGN PATENT DOCUMENTS

KR 20200121156 A * 10/2020
WO WO-2021016196 A1 * 1/2021 ..... F16M 11/245

* cited by examiner

*Primary Examiner* — Mariceli Santiago
(74) *Attorney, Agent, or Firm* — Wood, Phillips, Katz, Clark & Mortimer

(57) ABSTRACT

Disclosed is a tripod lamp including a bracket assembly, a lighting assembly for lighting, and a tripod assembly for supporting standing. The bracket assembly includes a telescopic structure, and a storage structure matching the lighting assembly for storing the lighting assembly. The tripod assembly is arranged on the telescopic structure. The lighting assembly is arranged on a telescopic end of the telescopic structure and moves synchronously with the telescopic end. The storage structure is arranged on a movement track of the lighting assembly and provided with an inlet/outlet port allowing the entry and exit of the lighting assembly into and from the storage structure. The tripod lamp is provided with a storage structure capable of storing a lighting assembly when not in use to protect the lighting assembly.

8 Claims, 9 Drawing Sheets

TRIPOD LAMP

TECHNICAL FIELD

The disclosure relates to the field of lighting devices, and in particular, to a tripod lamp.

BACKGROUND

In daily life, lighting lamps have become an indispensable tool. Tripod lamps, widely used indoors, outdoors, and in construction sites, are common lighting lamps.

However, no matter whether the existing tripod lamps are in a lighting state or not, lighting lamp bodies are all exposed outside. An external environment such as sand and dust will cause damage to the lighting lamp bodies, thereby affecting the service life.

SUMMARY

In order to overcome the deficiencies in the prior art, the disclosure provides a tripod lamp, which is provided with a storage structure capable of storing a lighting assembly when not in use to protect the lighting assembly.

In order to achieve the above object, the disclosure is implemented using the following technical solution:

A tripod lamp includes a bracket assembly, a lighting assembly for lighting, and a tripod assembly for supporting standing. The bracket assembly includes a telescopic structure, and a storage structure matching the lighting assembly for storing the lighting assembly. The tripod assembly is arranged on the telescopic structure. The lighting assembly is arranged on a telescopic end of the telescopic structure and moves synchronously with the telescopic end. The storage structure is arranged on a movement track of the lighting assembly and provided with an inlet/outlet port allowing the entry and exit of the lighting assembly into and from the storage structure.

With the above structure, when a user needs to use the tripod lamp, the tripod lamp stands by means of the tripod assembly, and then the telescopic structure is operated so that the telescopic end extends or retracts to synchronously drive the movement of the lighting assembly, whereby the lighting assembly is separated from the storage structure by means of the inlet/outlet port. At this moment, the user may control the operation of the lighting assembly.

After finishing using the tripod lamp, the user operates the telescopic structure reversely so that the telescopic end moves reversely to synchronously drive the reverse movement of the lighting assembly, whereby the lighting assembly re-enters the storage structure by means of the inlet/outlet port, and the storage operation on the lighting assembly is completed.

The storage structure in the above structure may protect the lighting assembly when the lighting assembly does not need to be used, so as to prevent damage to the lighting assembly caused by external objects and so on, thereby greatly prolonging the service life of the tripod lamp. Moreover, switching between storage and non-storage of the lighting assembly is realized by means of a telescopic action. The structure is simple, the operation is simple, and the volume after storage is relatively small and compact.

Further, the storage structure is arranged on one side of the lighting assembly and located on one side, in a retraction direction, of the telescopic end.

With the above structure, when extending, the telescopic end may synchronously drive the synchronous movement of the lighting assembly, whereby the lighting assembly is separated from the storage structure by means of the inlet/outlet port.

When retracting, the telescopic end may synchronously drive the synchronous movement of the lighting assembly, whereby the lighting assembly enters the storage structure by means of the inlet/outlet port.

Further, the lighting assembly includes a lamp holder connected to the telescopic end, and a lamp body arranged on the lamp holder.

The lamp holder is rotatably arranged on the telescopic end, and a rotating shaft of the lamp holder rotating relative to the telescopic end is perpendicular to a telescoping direction of the telescopic structure.

The lamp body is rotatably arranged on the lamp holder, and a rotating shaft of the lamp body rotating relative to the lamp holder is perpendicular to the rotating shaft of the lamp holder rotating relative to the telescopic end.

The lamp body is a sheet-shaped LED lamp, and therefore, when the lighting assembly is stored in the storage structure, a light-emitting surface of the lamp body is parallel to the inlet/outlet port so as to facilitate storage. With the above structure, when the lamp body is separated from the storage structure, the user may rotate the lamp holder so that the light-emitting surface of the lamp body is not perpendicular to a telescoping direction, usually parallel to the telescoping direction. The user may adjust the orientation of the light-emitting surface of the lamp body by rotating the lamp body.

Of course, after the tripod lamp is used, the user needs to reversely rotate the lamp body and the lamp holder so that the lighting lamp body can re-enter the storage structure.

Further, a plurality of lamp bodies are arranged.

With the above structure, the tripod lamp can illuminate different directions simultaneously.

Further, the lamp body is a sheet-shaped LED lamp. One side of the lamp body is formed as the light-emitting surface, and a heat sink is arranged on a side of the lamp body opposite to the light-emitting surface.

Further, a lamp holder rotating shaft is arranged on the telescopic end, the lamp holder is rotatably arranged on the telescopic end by means of the lamp holder rotating shaft, and the lamp holder is rotatably arranged relative to the lamp holder rotating shaft. A lamp holder positioning portion is arranged on the lamp holder rotating shaft, and a positioning groove is provided on a side wall of the lamp holder positioning portion. The lamp holder is provided with a lamp holder positioning member, and a lamp holder positioning elastic member acting on the lamp holder positioning member so that the lamp holder positioning member has a tendency to move toward the side wall of the lamp holder positioning portion. An end of the lamp holder positioning member facing the lamp holder positioning portion is provided with a lamp holder positioning protrusion matching the positioning groove.

A side wall of the positioning groove of the lamp holder and/or a side wall of the lamp holder positioning protrusion is provided with a first guide slope for guiding the lamp holder positioning member to move in a direction away from the side wall of the lamp holder positioning portion.

With the above structure, when rotating the lamp holder, the lamp holder rotates relative to the lamp holder rotating shaft, and the lamp holder positioning member rotates synchronously with the lamp holder. Due to the arrangement of the lamp holder positioning elastic member, the lamp holder positioning protrusion of the lamp holder positioning member is in contact with the side wall of the lamp holder positioning portion. When the lamp holder positioning protrusion is clamped into the positioning groove, the positioning protrusion fits the positioning groove to limit the rotation of the lamp holder to achieve positioning.

When the user continues to rotate the lamp holder or rotates the lamp holder reversely after the lamp holder positioning protrusion is clamped into the positioning groove, due to the arrangement of the first guide slope, the lamp holder positioning member moves away from the side wall of the lamp holder positioning portion against the action force of the lamp holder positioning elastic member so that the lamp holder positioning protrusion is separated from the positioning groove of the lamp holder. At this moment, the rotation of the lamp holder is unlimited.

Specifically, when the lamp holder is rotated so that the light-emitting surface of the lamp body is parallel to the telescoping direction of the telescopic structure, the lamp holder positioning protrusion is clamped into the positioning groove of the lamp holder. The lamp holder positioning elastic member is a spring.

Further, a lamp holder rotating shaft is arranged on the lamp body, and the lamp body is drivingly arranged on the lamp holder by means of the lamp body rotating shaft. The lamp body rotating shaft is provided with a first lamp body positioning gear rotating synchronously therewith. The lamp holder is provided with a second lamp body positioning gear matching the first lamp body positioning gear, and a lamp body positioning elastic member acting on the second lamp body positioning gear so that the second lamp body positioning gear has a tendency to move toward the first lamp body positioning gear. The second positioning gear is limited to rotate relative to the lamp holder. A side of the first lamp body positioning gear facing the second lamp body positioning gear is provided with a first lamp body positioning tooth surface, and a side of the second lamp body positioning gear facing the first lamp body positioning gear is provided with a second lamp body positioning tooth surface matching the first lamp body positioning tooth surface.

With the above structure, the first lamp body positioning gear rotates synchronously with the lamp body rotating shaft, and the second positioning gear is limited to rotate relative to the lamp holder. That is, the first lamp body positioning gear rotates relative to the second positioning gear. The first lamp body positioning gear fits the second positioning gear to achieve the rotational positioning of the lamp body.

The rotation of the lamp body may be limited when the first lamp body positioning tooth surface and the second lamp body positioning tooth surface are meshed under the action of the lamp body positioning elastic member.

When the user rotates the lamp body, the second lamp body positioning gear moves away from the first lamp body positioning gear under the action of a second guide slope in the first lamp body positioning tooth surface and the second lamp body positioning tooth surface, so that the first lamp body positioning tooth surface rotates relative to the second lamp body positioning tooth surface by one tooth. The second lamp body positioning gear makes the second lamp body positioning tooth surface re-meshed with the first lamp body positioning tooth surface under the action of the lamp body positioning elastic member.

Specifically, the lamp body positioning elastic member is a spring. The lamp body rotating shaft and the lamp holder are respectively provided with a first mounting limiting portion with a non-circular cross section. The first lamp body positioning gear and the second lamp body positioning gear are respectively provided with a second mounting limiting portion matching the first mounting limiting portion. The first mounting limiting portion and the second mounting limiting portion fit to limit the rotation of the first lamp body positioning gear relative to the lamp body rotating shaft, and to limit the rotation of the second lamp body positioning gear relative to the lamp holder.

Further, the tripod lamp includes a cover plate for covering the inlet/outlet port.

With the above structure, when the user operates the telescopic structure so that the lighting structure is stored in the storage structure, the user may operate the cover plate to cover the inlet/outlet port. The arrangement of the cover plate further enhances the protection of the lighting structure. When the lighting structure is stored in the storage structure, the cover plate covers the inlet/outlet port to protect the light-emitting surface of the lighting structure in a state where the light-emitting surface of the lighting structure faces the inlet/outlet port.

Further, the cover plate is movably arranged on the storage structure. Specifically, the cover plate is rotatably arranged on the storage structure.

With the above structure, it is possible to effectively prevent the cover plate from being lost.

Further, the storage structure is provided with a first holding portion for holding the cover plate to cover the inlet/outlet port, and a second holding portion for holding the cover plate to uncover the inlet/outlet port.

With the above structure, the arrangement of the first holding portion and the arrangement of the second holding portion may maintain the state of the cover plate, thereby enhancing the use experience.

Specifically, the first holding portion and the second holding portion are formed as a protrusion. The cover plate is provided with a first holding hole matching the first holding portion and a second holding hole matching the second holding portion. The first holding hole is in detachable snap-fit with the first holding portion, and the second holding hole is in detachable snap-fit with the second holding portion.

Further, the tripod assembly includes a tripod connecting member arranged on the telescopic structure, and a plurality of supporting legs arranged on the tripod connecting member. Specifically, three supporting legs are arranged.

Further, the plurality of supporting legs include at least one adjustable supporting leg. The adjustable supporting leg is telescopic in a length direction thereof.

With the above structure, by adjusting the adjustable supporting leg, the tripod lamp can stand on a slope.

Further, the adjustable supporting leg includes a first leg and a second leg. One end of the first leg is arranged on the tripod connecting member, and the other end is formed as a first sliding portion. One end of the second leg is formed as a second sliding portion matching the first sliding portion. The second leg is slidably arranged on the first leg by means of the fit of the first sliding portion and the second sliding portion. A length direction of the second leg is consistent with a length direction of the first leg, and a sliding direction of the second leg relative to the first leg is consistent with the length direction of the first leg.

Further, the adjustable supporting leg further includes a leg locking member. The leg locking member acts on the second leg to limit or allow the second leg to slide relative to the first leg. The leg locking member is a bolt. The leg locking member is rotatably arranged on the first sliding portion of the first leg, and an axial movement direction thereof when rotating is a direction close to and away from the second sliding portion of the second leg.

Further, the second sliding portion is provided with an I-shaped sliding block in a sliding direction thereof. Correspondingly, the first sliding portion is provided with sliding rails on two sides of the I-shaped sliding block, and the sliding rails protrude toward the I-shaped sliding block to form a protruding block matching a groove on the I-shaped sliding block.

With the above structure, the I-shaped sliding block on the second sliding portion fits the sliding rails on the first sliding portion to achieve stable sliding of the second leg.

Specifically, the second sliding portion is provided, outside the sliding rails, with a sliding block connecting portion for connecting the I-shaped sliding block.

Further, the first sliding portion is provided with a first limiting portion and a second limiting portion in the sliding direction of the second leg. The second sliding portion is provided with a third limiting portion matching the first limiting portion and a fourth limiting portion matching the second limiting portion in the sliding direction of the second leg.

The first limiting portion fits the third limiting portion and the second limiting portion fits the fourth limiting portion to limit the sliding range of the second leg.

Specifically, a side of the first sliding portion close to the tripod connecting member protrudes to form the first limiting portion, and the sliding block connecting portion on the second sliding portion is formed and serves as the third limiting portion. When the second leg slides close to the tripod connecting member, the third limiting portion, i.e. the sliding block connecting portion, may abut against the first limiting portion to limit the second leg from continuing to slide in this direction.

A side of the I-shaped sliding block on the second sliding portion close to the tripod connecting member protrudes to form the fourth limiting portion, and a side of the first sliding portion away from the tripod connecting member protrudes to form the second limiting portion. When the second leg slides away from the tripod connecting member, the fourth limiting portion may abut against the second limiting portion to limit the second leg from continuing to slide in this direction.

Further, the tripod connecting member is slidably arranged on the telescopic structure, and the supporting legs are rotatably arranged on the tripod connecting member. When the tripod connecting member slides relative to the telescopic structure, the supporting legs may be driven to rotate so that the supporting legs move close to and away from each other.

The sliding direction of the tripod connecting member is consistent with the telescoping direction of the telescopic structure.

With the above structure, the user slides the tripod connecting member to unfold and fold the supporting legs.

Specifically, the tripod connecting member includes a connecting rod. One end of the connecting rod is rotatably connected to the telescopic structure, and the other end is rotatably connected to the supporting leg. When the user slides the tripod connecting member, the connecting rod may act on the supporting leg to unfold out or fold back the supporting leg.

Further, the tripod assembly includes a slidable positioning structure for slidably positioning the tripod connecting member. The slidable positioning structure includes a positioning column, and an operating member for driving the positioning column to move close to and away from the telescopic structure. The telescopic structure is provided with a positioning hole matching the positioning column. The tripod assembly further includes a slidable positioning elastic member acting on the positioning column so that the positioning column has a tendency to move toward the telescopic structure. The slidable positioning elastic member is a spring.

With the above structure, the user may position the tripod connecting member by means of the slidable positioning structure. For example, the tripod connecting member is positioned such that the supporting leg is fully folded or fully unfolded.

Specifically, the user operates the operating member so that the positioning column is separated from the positioning hole away from the telescopic structure. At this moment, the user may slide the tripod connecting member. When sliding the tripod connecting member to a required position, the user releases the operating member. Under the action of the slidable positioning elastic member, the positioning column moves close to the telescopic structure and is clamped into the positioning hole corresponding to the position. More specifically, the positioning hole includes a first positioning hole and a second positioning hole. In a state where the positioning column is clamped into the first positioning hole, the tripod connecting member is positioned such that the supporting leg is fully folded. In a state where the positioning column is clamped into the second positioning hole, the tripod connecting member is positioned such that the supporting leg is fully unfolded.

Further, the telescopic structure is a telescopic rod structure, including a first telescopic rod, a second telescopic rod sheathed outside the first telescopic rod, and a telescopic seat sheathed outside the second telescopic rod.

With the above structure, the first telescopic rod slidably telescopes relative to the second telescopic rod, and the second telescopic rod slidably telescopes relative to the telescopic seat to realize the telescopic function of the telescopic structure.

Specifically, the telescopic seat is provided with an outer cylinder. The tripod assembly is arranged on the outer cylinder. That is, the tripod connecting member is slidably arranged on the outer cylinder.

Further, the telescoping structure includes a locking structure. The locking structure acts on the first telescoping rod to allow or limit axial movement of the first telescoping rod relative to the second telescoping rod and acts on the second telescoping rod to allow or limit axial movement of the second telescoping rod relative to the telescoping seat.

With the above structure, the locking structure is configured to achieve the telescopic positioning of the telescopic structure. Specifically, the locking structure includes a first locking member and a second locking member. The first locking member acts on the first telescoping rod to allow or limit axial movement of the first telescoping rod relative to the second telescoping rod. The second locking member acts on the second telescoping rod to allow or limit axial movement of the second telescoping rod relative to the telescoping seat. The first locking member and the second locking member are quick-release locking fasteners.

The disclosure has the following beneficial effects compared to the prior art:

(1) The tripod lamp of the disclosure is provided with a storage structure capable of storing a lighting assembly when not in use to protect the lighting assembly. Moreover, a telescopic function of a telescopic structure achieves that the lighting assembly enters and exits the storage structure. The structure is compact.

(2) The tripod lamp of the disclosure is provided with a cover plate, which further protects the lighting assembly stored in the storage structure.

(3) The tripod lamp of the disclosure is provided with an adjustable supporting leg capable of adjusting the length thereof to enable the tripod lamp to stand on different landforms, such as slopes.

Figure 1:
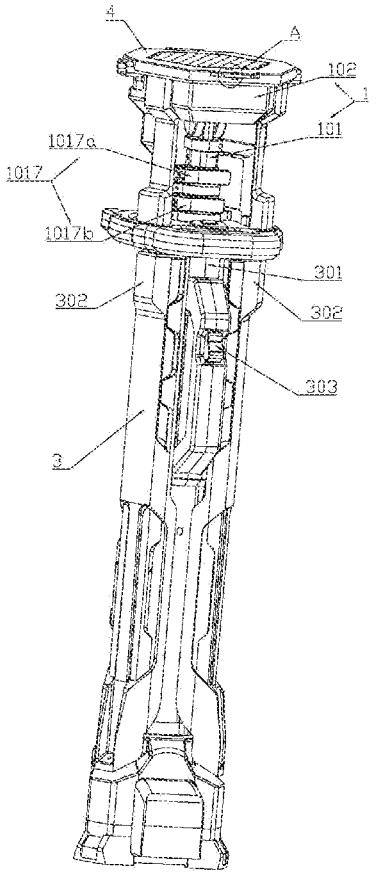
FIG. 1 is a structure diagram of a tripod lamp in a folded state according to the disclosure.

Reference Numerals: 1, bracket assembly; 101, telescopic structure; 1011, telescopic end; 1012, lamp holder rotating shaft; 1013, lamp holder positioning portion; 1013*a*, positioning groove; 1014, first telescoping rod; 1015, second telescoping rod; 1016, telescopic seat; 1016*a*, outer cylinder; 1017, locking structure; 1017*a*, first locking member; 1017*b*, second locking member; 102, storage structure; 1021, inlet/outlet port; 1022, first holding portion; 1023, second holding portion; 2, lighting assembly; 201, lamp holder; 2011, lamp holder positioning member; 2011*a*, lamp holder positioning protrusion; 2012, lamp holder positioning elastic member; 2013, second lamp body positioning gear; 2013*a*, second lamp body positioning tooth surface; 2014, lamp body positioning elastic member; 202, lamp body; 2021, lamp body rotating shaft; 2022, first lamp body positioning gear; 2022*a*, first lamp body positioning tooth surface; 2023, light-emitting surface; 2024, heat sink; 3, tripod assembly; 301, tripod connecting member; 302, supporting leg; 3021, adjustable supporting leg; 3021*a*, first leg; 3021*a*1, first sliding portion; 3021*a*2, sliding rail; 3021*a*21, protruding block; 3021*a*3, first limiting portion; 3021*a*4, second limiting portion; 3021*b*, second leg; 3021*b*1, second sliding portion; 3021*b*2, I-shaped sliding block; 3021*b*3, third limiting portion; 3021*b*4, fourth limiting portion; 3021*b*5, sliding block connecting portion; 3021*c*, leg locking member; 303, slidable positioning structure; 3031, positioning column; 3032, operating member; 3033, positioning hole; 3033*a*, first positioning hole; 3033*b*, second positioning hole; 3034, slidable positioning elastic member; 304, connecting rod; 4, cover plate; 401, first holding hole; 402, second holding hole; 5, first guide slope; 6, first mounting limiting portion; 7, second mounting limiting portion.

DETAILED DESCRIPTION

Specific implementations of the disclosure will be described below in further detail with reference to the accompanying drawings and embodiments. The following embodiments serve to illustrate the disclosure but are not intended to limit the scope thereof.

Figure 2:
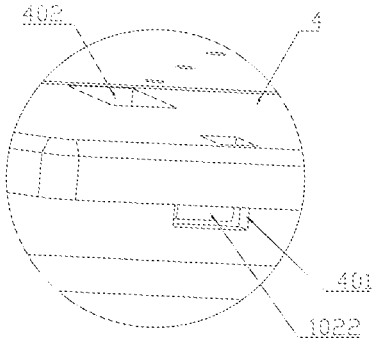
FIG. 2 is an enlarged view of part A in FIG. 1.
Figure 3:
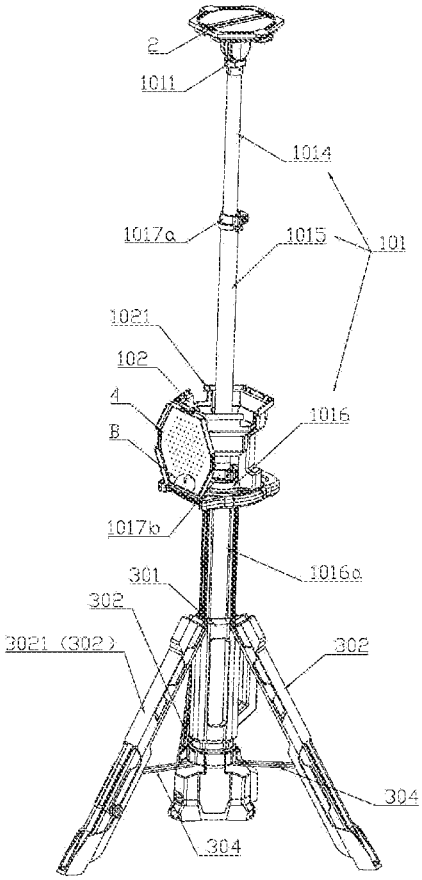
FIG. 3 is a structure diagram of a tripod lamp in an unfolded state according to the disclosure.
Figure 4:
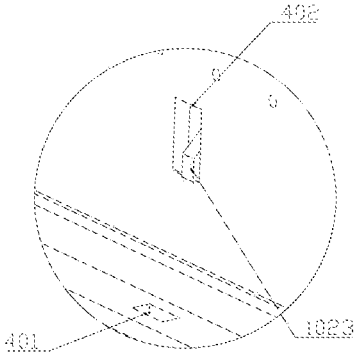
FIG. 4 is an enlarged view of part B in FIG. 3.
Figure 5:
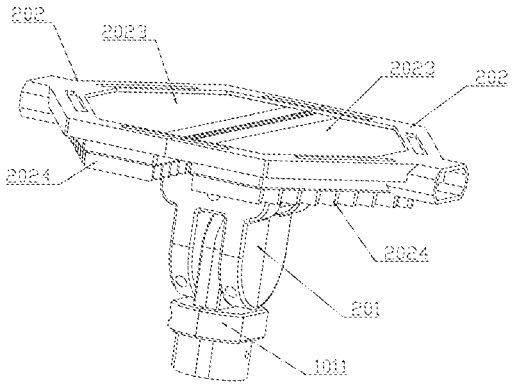
FIG. 5 is a diagram of a lighting structure in a tripod lamp according to the disclosure.
Figure 6:
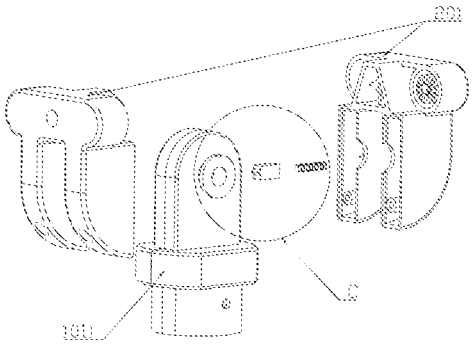
FIG. 6 is a mounting structure diagram of a lamp holder in a tripod lamp according to the disclosure.
Figure 7:
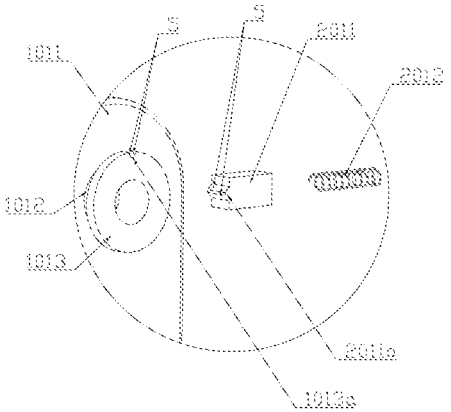
FIG. 7 is an enlarged view of part C in FIG. 6.
Figure 8:
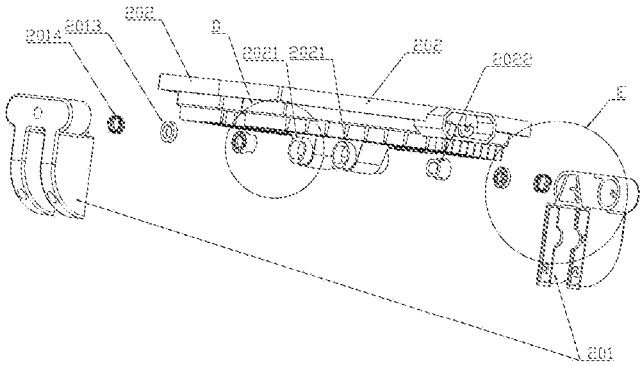
FIG. 8 is a mounting structure diagram of a lamp body in a tripod lamp according to the disclosure.
Figure 9:
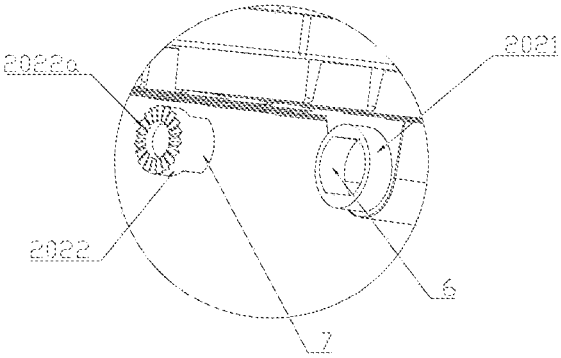
FIG. 9 is an enlarged view of part D in FIG. 8.
Figure 10:
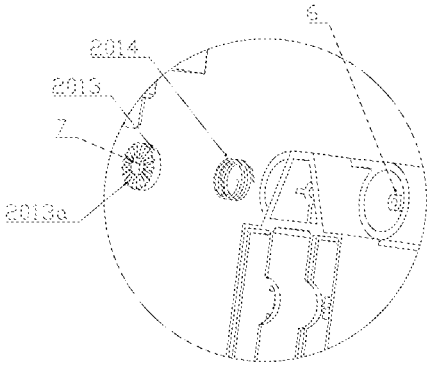
FIG. 10 is an enlarged view of part E in FIG. 8.
Figure 11:
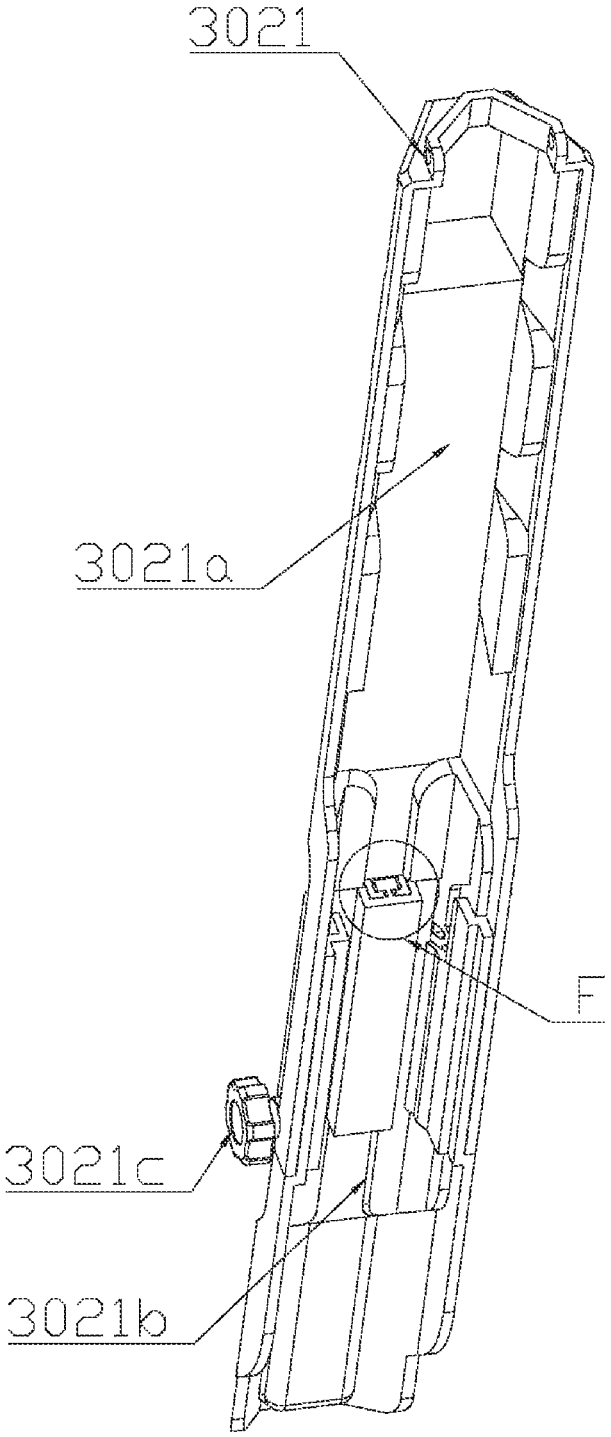
FIG. 11 is a structure diagram of an adjustable supporting leg in a tripod lamp according to the disclosure.
Figure 12:
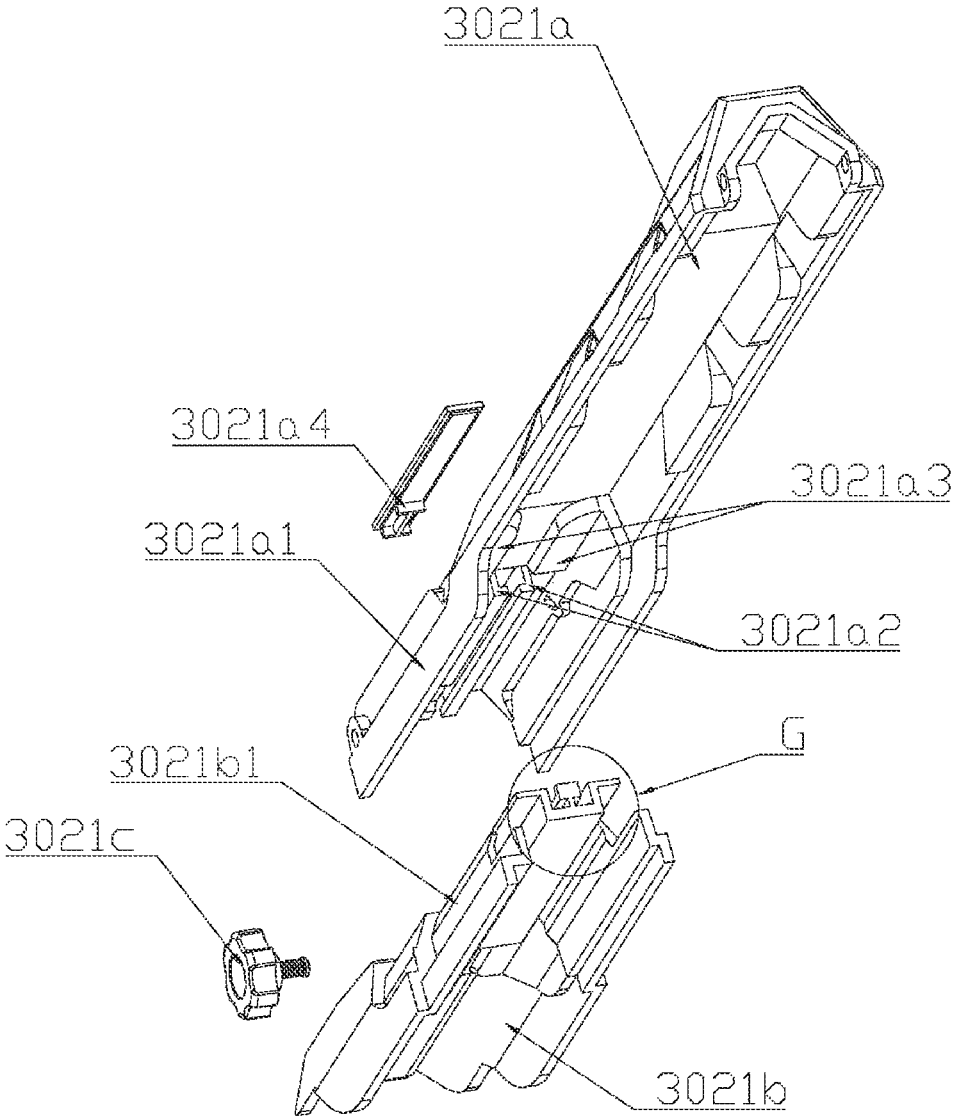
FIG. 12 is an exploded structure diagram of an adjustable supporting leg in a tripod lamp according to the disclosure.
Figure 13:
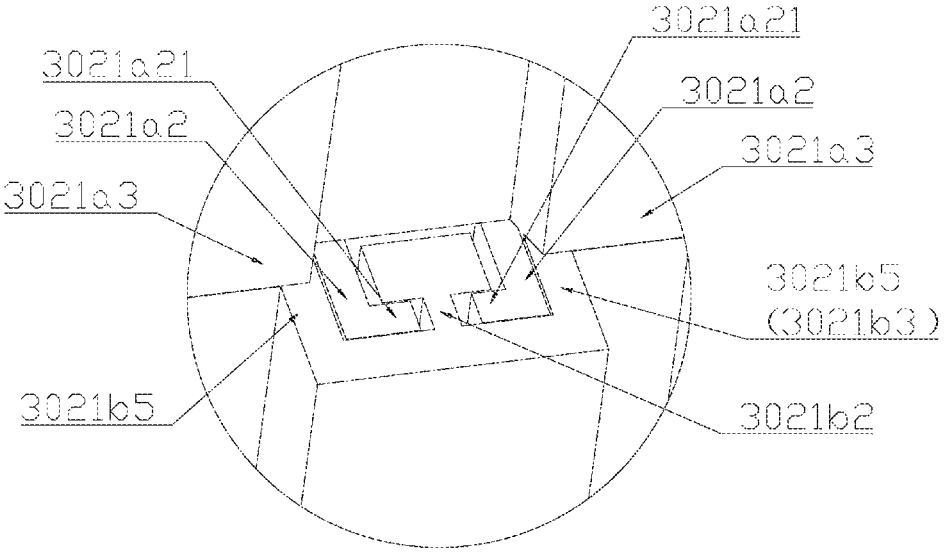
FIG. 13 is an enlarged view of part F in FIG. 11.
Figure 14:
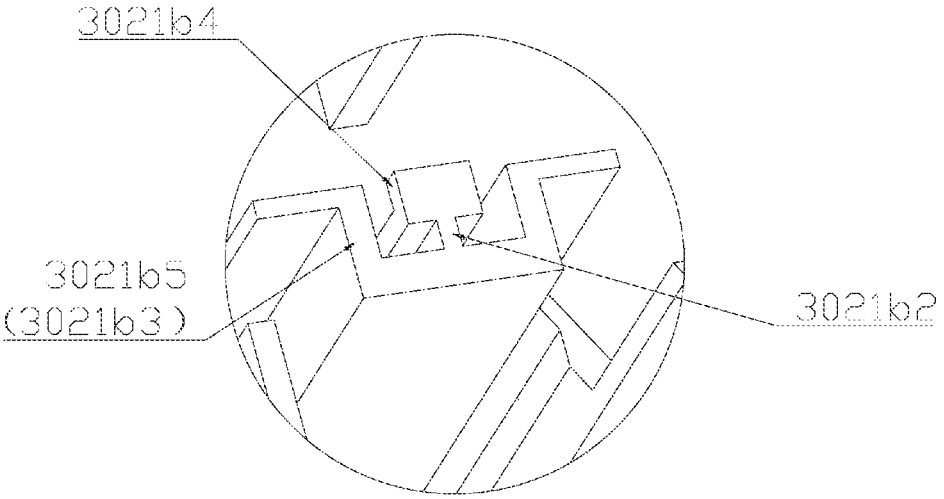
FIG. 14 is an enlarged view of part G in FIG. 12.
Figure 15:
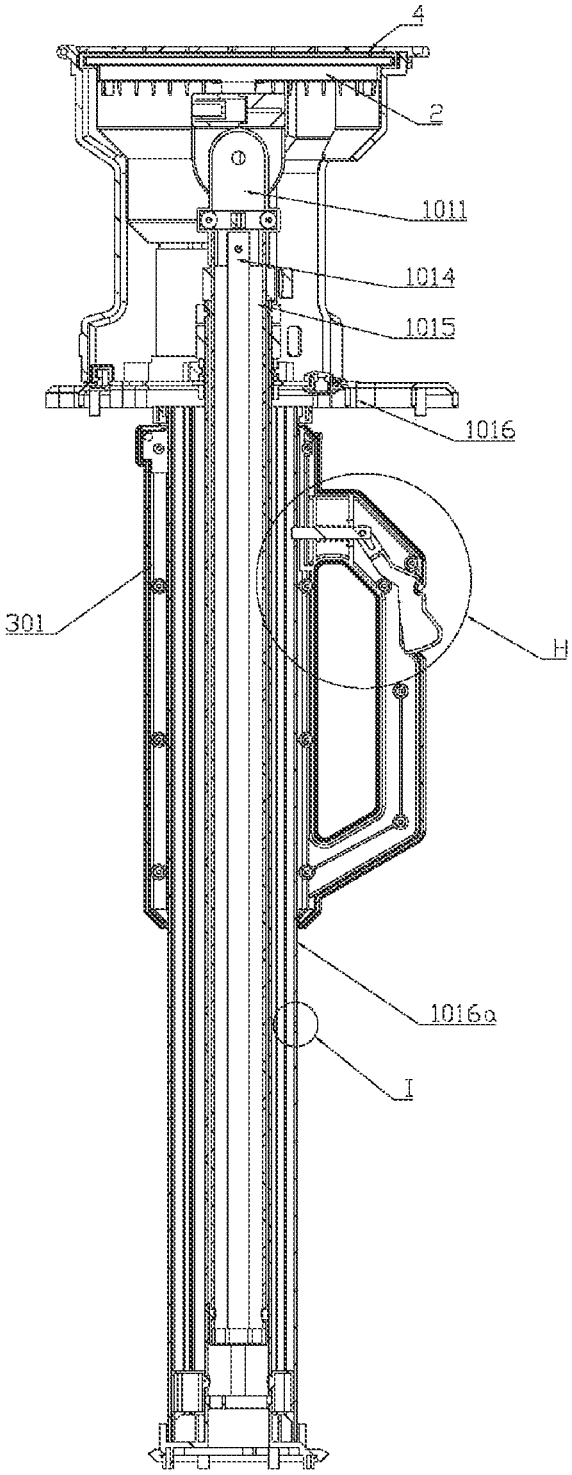
FIG. 15 is a structure diagram of a slidable positioning structure in a tripod lamp according to the disclosure.
Figure 16:
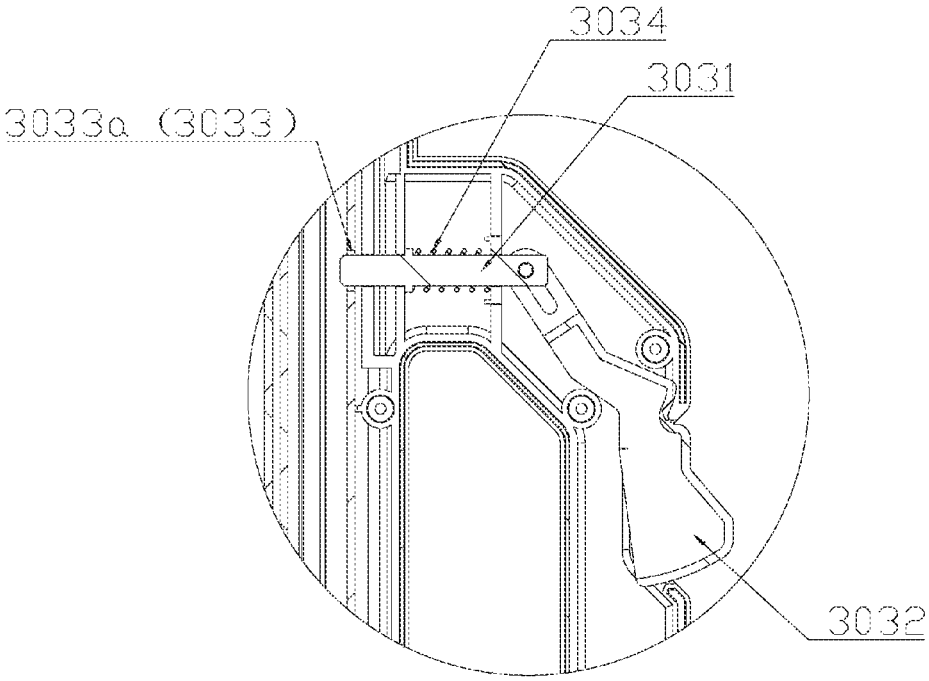
FIG. 16 is an enlarged view of part H in FIG. 15.
Figure 17:
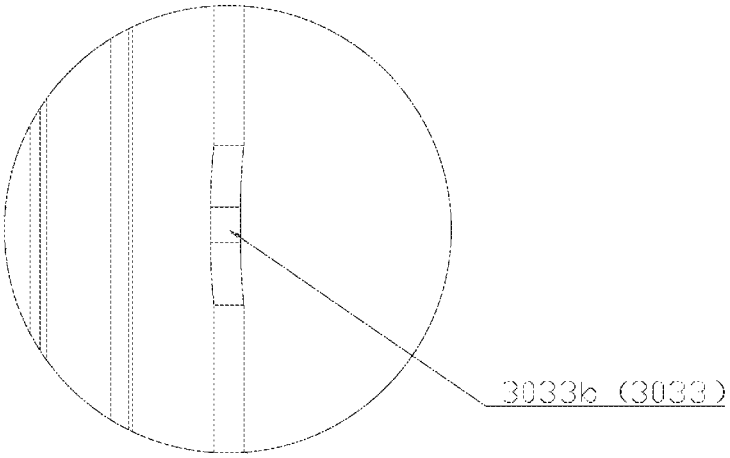
FIG. 17 is an enlarged view of part I in FIG. 15.

As shown in FIGS. 1-17, a tripod lamp includes a bracket assembly 1, a lighting assembly 2 for lighting, and a tripod assembly 3 for supporting standing. The bracket assembly 1 includes a telescopic structure 101, and a storage structure 102 matching the lighting assembly 2 for storing the lighting assembly 2. The tripod assembly 3 is arranged on the telescopic structure 101. The lighting assembly 2 is arranged on a telescopic end 1011 of the telescopic structure 101 and moves synchronously with the telescopic end 1011. The storage structure 102 is arranged on a movement track of the lighting assembly 2 and provided with an inlet/outlet port 1021 allowing the entry and exit of the lighting assembly 2 into and from the storage structure 102.

With the above structure, when a user needs to use the tripod lamp, the tripod lamp stands by means of the tripod assembly 3, and then the telescopic structure 101 is operated so that the telescopic end 1011 extends or retracts to synchronously drive the movement of the lighting assembly 2, whereby the lighting assembly 2 is separated from the storage structure 102 by means of the inlet/outlet port 1021. At this moment, the user may control the operation of the lighting assembly 2.

After finishing using the tripod lamp, the user operates the telescopic structure 101 reversely so that the telescopic end 1011 moves reversely to synchronously drive the reverse movement of the lighting assembly 2, whereby the lighting assembly 2 re-enters the storage structure 102 by means of the inlet/outlet port 1021, and the storage operation on the lighting assembly 2 is completed.

The storage structure 102 in the above structure may protect the lighting assembly 2 when the lighting assembly 2 does not need to be used, so as to prevent damage to the lighting assembly 2 caused by external objects and so on, thereby greatly prolonging the service life of the tripod lamp. Moreover, switching between storage and non-storage of the lighting assembly 2 is realized by means of a telescopic action. The structure is simple, the operation is simple, and the volume after storage is relatively small and compact.

Preferably, the storage structure 102 is arranged on one side of the lighting assembly 2 and located on one side, in a retraction direction, of the telescopic end 1011.

With the above structure, when extending, the telescopic end 1011 may synchronously drive the synchronous movement of the lighting assembly 2, whereby the lighting assembly is separated from the storage structure 102 by means of the inlet/outlet port 1021.

When retracting, the telescopic end 1011 may synchronously drive the synchronous movement of the lighting assembly 2, whereby the lighting assembly enters the storage structure 102 by means of the inlet/outlet port 1021.

Preferably, the lighting assembly 2 includes a lamp holder 201 connected to the telescopic end 1011, and a lamp body 202 arranged on the lamp holder 201.

The lamp holder 201 is rotatably arranged on the telescopic end 1011, and a rotating shaft of the lamp holder 201 rotating relative to the telescopic end 1011 is perpendicular to a telescoping direction of the telescopic structure 101.

The lamp body 202 is rotatably arranged on the lamp holder 201, and a rotating shaft of the lamp body 202 rotating relative to the lamp holder 201 is perpendicular to the rotating shaft of the lamp holder 201 rotating relative to the telescopic end 1011.

The lamp body 202 is a sheet-shaped LED lamp, and therefore, when the lighting assembly 2 is stored in the storage structure 102, a light-emitting surface 2023 of the lamp body 202 is parallel to the inlet/outlet port 1021 so as to facilitate storage. With the above structure, when the lamp body 202 is separated from the storage structure 102, the user may rotate the lamp holder 201 so that the light-emitting surface 2023 of the lamp body 202 is not perpendicular to a telescoping direction, usually parallel to the telescoping direction. The user may adjust the orientation of the light-emitting surface 2023 of the lamp body by rotating the lamp body 202.

Of course, after the tripod lamp is used, the user needs to reversely rotate the lamp body 202 and the lamp holder 201 so that the lighting lamp body 202 can re-enter the storage structure 102.

Preferably, a plurality of lamp bodies 202 are arranged.

With the above structure, the tripod lamp can illuminate different directions simultaneously.

Preferably, the lamp body 202 is a sheet-shaped LED lamp. One side of the lamp body 202 is formed as the light-emitting surface 2023, and a heat sink 2024 is arranged on a side of the lamp body 202 opposite to the light-emitting surface 2023.

Preferably, a lamp holder rotating shaft 1012 is arranged on the telescopic end 1011, the lamp holder 201 is rotatably arranged on the telescopic end 1011 by means of the lamp holder rotating shaft 1012, and the lamp holder 201 is rotatably arranged relative to the lamp holder rotating shaft 1012. A lamp holder positioning portion 1013 is arranged on the lamp holder rotating shaft 1012, and a positioning groove 1013*a* is provided on a side wall of the lamp holder positioning portion 1013. The lamp holder 201 is provided with a lamp holder positioning member 2011, and a lamp holder positioning elastic member 2012 acting on the lamp holder positioning member 2011 so that the lamp holder positioning member has a tendency to move toward the side wall of the lamp holder positioning portion 1013. An end of the lamp holder positioning member 2011 facing the lamp holder positioning portion is provided with a lamp holder positioning protrusion 2011*a* matching the positioning groove 1013*a*.

A side wall of the positioning groove 1013*a* of the lamp holder 201 and/or a side wall of the lamp holder positioning protrusion 2011*a* is provided with a first guide slope 5 for guiding the lamp holder positioning member 2011 to move in a direction away from the side wall of the lamp holder positioning portion 1013.

With the above structure, when rotating the lamp holder 201, the lamp holder 201 rotates relative to the lamp holder rotating shaft 1012, and the lamp holder positioning member 2011 rotates synchronously with the lamp holder 201. Due to the arrangement of the lamp holder positioning elastic member 2012, the lamp holder positioning protrusion 2011*a* of the lamp holder positioning member 2011 is in contact with the side wall of the lamp holder positioning portion 1013. When the lamp holder positioning protrusion 2011*a* is clamped into the positioning groove 1013*a*, the positioning protrusion fits the positioning groove 1013*a* to limit the rotation of the lamp holder 201 to achieve positioning.

When the user continues to rotate the lamp holder 201 or rotates the lamp holder 201 reversely after the lamp holder positioning protrusion 2011*a* is clamped into the positioning groove 1013*a*, due to the arrangement of the first guide slope 5, the lamp holder positioning member 2011 moves away from the side wall of the lamp holder positioning portion 1013 against the action force of the lamp holder positioning elastic member 2012 so that the lamp holder positioning protrusion 2011*a* is separated from the positioning groove 1013*a* of the lamp holder 201. At this moment, the rotation of the lamp holder 201 is unlimited.

Specifically, when the lamp holder 201 is rotated so that the light-emitting surface 2023 of the lamp body 202 is parallel to the telescoping direction of the telescopic structure 101, the lamp holder positioning protrusion 2011*a* is clamped into the positioning groove 1013*a* of the lamp holder 201. The lamp holder positioning elastic member 2012 is a spring.

Preferably, a lamp holder rotating shaft 2021 is arranged on the lamp body 202, and the lamp body 202 is drivingly arranged on the lamp holder 201 by means of the lamp body rotating shaft 2021. The lamp body rotating shaft 2021 is provided with a first lamp body positioning gear 2022 rotating synchronously therewith. The lamp holder 201 is provided with a second lamp body positioning gear 2013 matching the first lamp body positioning gear 2022, and a lamp body positioning elastic member 2014 acting on the second lamp body positioning gear 2013 so that the second lamp body positioning gear has a tendency to move toward the first lamp body positioning gear 2022. The second positioning gear is limited to rotate relative to the lamp holder 201. A side of the first lamp body positioning gear 2022 facing the second lamp body positioning gear 2013 is provided with a first lamp body positioning tooth surface 2022*a*, and a side of the second lamp body positioning gear 2013 facing the first lamp body positioning gear 2022 is provided with a second lamp body positioning tooth surface 2013*a* matching the first lamp body positioning tooth surface 2022*a*.

With the above structure, the first lamp body positioning gear 2022 rotates synchronously with the lamp body rotating shaft 2021, and the second positioning gear is limited to rotate relative to the lamp holder 201. That is, the first lamp body positioning gear 2022 rotates relative to the second positioning gear. The first lamp body positioning gear 2022 fits the second positioning gear to achieve the rotational positioning of the lamp body 202.

The rotation of the lamp body 202 may be limited when the first lamp body positioning tooth surface 2022*a* and the second lamp body positioning tooth surface 2013*a* are meshed under the action of the lamp body positioning elastic member 2014.

When the user rotates the lamp body 202, the second lamp body positioning gear 2013 moves away from the first lamp body positioning gear 2022 under the action of a second guide slope in the first lamp body positioning tooth surface 2022*a* and the second lamp body positioning tooth surface 2013*a*, so that the first lamp body positioning tooth surface 2022*a* rotates relative to the second lamp body positioning tooth surface 2013*a* by one tooth. The second lamp body positioning gear 2013 makes the second lamp body positioning tooth surface 2013*a* re-meshed with the first lamp body positioning tooth surface 2022*a* under the action of the lamp body positioning elastic member 2014.

Specifically, the lamp body positioning elastic member 2014 is a spring. The lamp body rotating shaft 2021 and the lamp holder 201 are respectively provided with a first mounting limiting portion 6 with a non-circular cross section. The first lamp body positioning gear 2022 and the second lamp body positioning gear 2013 are respectively provided with a second mounting limiting portion 7 matching the first mounting limiting portion 6. The first mounting limiting portion 6 and the second mounting limiting portion 7 fit to limit the rotation of the first lamp body positioning gear 2022 relative to the lamp body rotating shaft 2021, and to limit the rotation of the second lamp body positioning gear 2013 relative to the lamp holder 201.

Preferably, the tripod lamp includes a cover plate 4 for covering the inlet/outlet port 1021.

With the above structure, when the user operates the telescopic structure 101 so that the lighting structure is stored in the storage structure 102, the user may operate the cover plate 4 to cover the inlet/outlet port 1021. The arrangement of the cover plate 4 further enhances the protection of the lighting structure. When the lighting structure is stored in the storage structure 102, the cover plate 4 covers the inlet/outlet port 1021 to protect a light-emitting surface 2023 of the lighting structure in a state where the light-emitting surface 2023 of the lighting structure faces the inlet/outlet port 1021.

Preferably, the cover plate 4 is movably arranged on the storage structure 102. Specifically, the cover plate 4 is rotatably arranged on the storage structure 102.

With the above structure, it is possible to effectively prevent the cover plate 4 from being lost.

Preferably, the storage structure 102 is provided with a first holding portion 1022 for holding the cover plate 4 to cover the inlet/outlet port 1021, and a second holding portion 1023 for holding the cover plate 4 to uncover the inlet/outlet port 1021.

With the above structure, the arrangement of the first holding portion 1022 and the arrangement of the second holding portion 1023 may maintain the state of the cover plate 4, thereby enhancing the use experience.

Specifically, the first holding portion 1022 and the second holding portion 1023 are formed as a protrusion. The cover plate 4 is provided with a first holding hole 401 matching the first holding portion 1022 and a second holding hole 402 matching the second holding portion 1023. The first holding hole is in detachable snap-fit with the first holding portion 1022, and the second holding hole 402 is in detachable snap-fit with the second holding portion 1023.

Preferably, the tripod assembly 3 includes a tripod connecting member 301 arranged on the telescopic structure 101, and a plurality of supporting legs 302 arranged on the tripod connecting member 301. Specifically, three supporting legs 302 are arranged.

Preferably, the plurality of supporting legs 302 include at least one adjustable supporting leg 3021. The adjustable supporting leg 3021 is telescopic in a length direction thereof.

With the above structure, by adjusting the adjustable supporting leg 3021, the tripod lamp can stand on a slope.

Preferably, the adjustable supporting leg 3021 includes a first leg 3021*a* and a second leg 3021*b*. One end of the first leg 3021*a* is arranged on the tripod connecting member 301, and the other end is formed as a first sliding portion 3021*a*1. One end of the second leg 3021*b* is formed as a second sliding portion 3021*b*1 matching the first sliding portion 3021*a*1. The second leg 3021*b* is slidably arranged on the first leg 3021*a* by means of the fit of the first sliding portion 3021*a*1 and the second sliding portion 3021*b*1. A length direction of the second leg 3021*b* is consistent with a length direction of the first leg 3021*a*, and a sliding direction of the second leg 3021*b* relative to the first leg 3021*a* is consistent with the length direction of the first leg 3021*a*.

Preferably, the adjustable supporting leg 3021 further includes a leg locking member 3021*c*. The leg locking member 3021*c* acts on the second leg 3021*b* to limit or allow the second leg to slide relative to the first leg 3021*a*. The leg locking member 3021*c* is a bolt. The leg locking member 3021*c* is rotatably arranged on the first sliding portion 3021*a*1 of the first leg 3021*a*, and an axial movement direction thereof when rotating is a direction close to and away from the second sliding portion 3021*b*1 of the second leg 3021*b*.

Preferably, the second sliding portion 3021*b*1 is provided with an I-shaped sliding block 3021*b*2 in a sliding direction thereof. Correspondingly, the first sliding portion 3021*a*1 is provided with sliding rails 3021*a*2 on two sides of the I-shaped sliding block 3021*b*2, and the sliding rails 3021*a*2 protrude toward the I-shaped sliding block 3021*b*2 to form a protruding block 3021*a*21 matching a groove on the I-shaped sliding block 3021*b*2.

With the above structure, the I-shaped sliding block 3021*b*2 on the second sliding portion 3021*b*1 fits the sliding rails 3021*a*2 on the first sliding portion 3021*a*1 to achieve stable sliding of the second leg 3021*b*.

Specifically, the second sliding portion 3021*b*1 is provided, outside the sliding rails 3021*a*2, with a sliding block connecting portion 3021*b*5 for connecting the I-shaped sliding block 3021*b*2.

Preferably, the first sliding portion 3021*a*1 is provided with a first limiting portion 3021*a*3 and a second limiting portion 3021*a*4 in the sliding direction of the second leg 3021*b*. The second sliding portion 3021*b*1 is provided with a third limiting portion 3021*b*3 matching the first limiting portion 3021*a*3 and a fourth limiting portion 3021*b*4 matching the second limiting portion 3021*a*4 in the sliding direction of the second leg 3021*b*.

The first limiting portion 3021*a*3 fits the third limiting portion 3021*b*3 and the second limiting portion 3021*a*4 fits the fourth limiting portion 3021*b*4 to limit the sliding range of the second leg 3021*b*.

Specifically, a side of the first sliding portion 3021*a*1 close to the tripod connecting member 301 protrudes to form the first limiting portion 3021*a*3, and the sliding block connecting portion 3021*b*5 on the second sliding portion 3021*b*1 is formed and serves as the third limiting portion 3021*b*3. When the second leg 3021*b* slides close to the tripod connecting member 301, the third limiting portion 3021*b*3, i.e. the sliding block connecting portion 3021*b*5, may abut against the first limiting portion 3021*a*3 to limit the second leg 3021*b* from continuing to slide in this direction.

A side of the I-shaped sliding block 3021*b*2 on the second sliding portion 3021*b*1 close to the tripod connecting member 301 protrudes to form the fourth limiting portion 3021*b*4, and a side of the first sliding portion 3021*a*1 away from the tripod connecting member 301 protrudes to form the second limiting portion 3021*a*4. When the second leg 3021*b* slides away from the tripod connecting member 301, the fourth limiting portion 3021*b*4 may abut against the second limiting portion 3021*a*4 to limit the second leg 3021*b* from continuing to slide in this direction.

Preferably, the tripod connecting member 301 is slidably arranged on the telescopic structure 101, and the supporting legs 302 are rotatably arranged on the tripod connecting member 301. When the tripod connecting member 301 slides relative to the telescopic structure 101, the supporting legs 302 may be driven to rotate so that the supporting legs 302 move close to and away from each other.

The sliding direction of the tripod connecting member 301 is consistent with the telescoping direction of the telescopic structure 101.

With the above structure, the user slides the tripod connecting member 301 to unfold the supporting legs 302 and fold the supporting legs 302.

Specifically, the tripod connecting member 3 includes a connecting rod 304. One end of the connecting rod 304 is rotatably connected to the telescopic structure 101, and the other end is rotatably connected to the supporting leg 302. When the user slides the tripod connecting member 301, the connecting rod 304 may act on the supporting leg 302 to unfold out or fold back the supporting leg.

Preferably, the tripod assembly 3 includes a slidable positioning structure 303 for slidably positioning the tripod connecting member 301. The slidable positioning structure 303 includes a positioning column 3031, and an operating member 3032 for driving the positioning column 3031 to move close to and away from the telescopic structure 101. The telescopic structure 101 is provided with a positioning hole 3033 matching the positioning column 3031. The tripod assembly 3 further includes a slidable positioning elastic member 3034 acting on the positioning column 3031 so that the positioning column has a tendency to move toward the telescopic structure 101. The slidable positioning elastic member 3034 is a spring.

With the above structure, the user may position the tripod connecting member 301 by means of the slidable positioning structure 303. For example, the tripod connecting member 301 is positioned such that the supporting leg 302 is fully folded or fully unfolded.

Specifically, the user operates the operating member 3032 so that the positioning column 3031 is separated from the positioning hole 3033 away from the telescopic structure 101. At this moment, the user may slide the tripod connecting member 301. When sliding the tripod connecting member 301 to a required position, the user releases the operating member 3032. Under the action of the slidable positioning elastic member 3034, the positioning column 3031 moves close to the telescopic structure 101 and is clamped into the positioning hole 3033 corresponding to the position. More specifically, the positioning hole 3033 includes a first positioning hole 3033*a* and a second positioning hole 3033*b*. In a state where the positioning column 3031 is clamped into the first positioning hole 3033*a*, the tripod connecting member 301 is positioned such that the supporting leg 302 is fully folded. In a state where the positioning column 3031 is clamped into the second positioning hole 3033*b*, the tripod connecting member 301 is positioned such that the supporting leg 302 is fully unfolded.

Preferably, the telescopic structure 101 is a telescopic rod structure, including a first telescopic rod 1014, a second telescopic rod 1015 sheathed outside the first telescopic rod 1014, and a telescopic seat 1016 sheathed outside the second telescopic rod 1015.

With the above structure, the first telescopic rod 1014 slidably telescopes relative to the second telescopic rod 1015, and the second telescopic rod 1015 slidably telescopes relative to the telescopic seat 1016 to realize the telescopic function of the telescopic structure 101.

Specifically, the telescopic seat 1016 is provided with an outer cylinder 1016*a*. The tripod assembly 3 is arranged on the outer cylinder 1016*a*. That is, the tripod connecting member 301 is slidably arranged on the outer cylinder 1016*a*.

Preferably, the telescoping structure 101 includes a locking structure 1017. The locking structure 1017 acts on the first telescoping rod 1014 to allow or limit axial movement of the first telescoping rod 1014 relative to the second telescoping rod 1015 and acts on the second telescoping rod 1015 to allow or limit axial movement of the second telescoping rod 1015 relative to the telescoping seat 1016.

With the above structure, the locking structure 1017 is configured to achieve the telescopic positioning of the telescopic structure 101. Specifically, the locking structure 1017 includes a first locking member 1017*a* and a second locking member 1017*b*. The first locking member 1017*a* acts on the first telescoping rod 1014 to allow or limit axial movement of the first telescoping rod 1014 relative to the second telescoping rod 1015. The second locking member 1017*b* acts on the second telescoping rod 1015 to allow or limit axial movement of the second telescoping rod 1015 relative to the telescoping seat 1016. The first locking member 1017*a* and the second locking member 1017*b* are quick-release locking fasteners.

The above descriptions are only preferred implementations of the disclosure. It should be noted that a number of improvements and modifications may be made by those of ordinary skill in the art without departing from the technical principles of the disclosure. Such improvements and modifications should also be considered to be within the scope of protection of the disclosure.

What is claimed is:

1. A tripod lamp, comprising: a bracket assembly (1), a lighting assembly (2) for lighting, and a tripod assembly (3) for supporting standing, wherein the bracket assembly (1) comprises a telescopic structure (101), and a storage structure (102) matching the lighting assembly (2) for storing the lighting assembly (2); the tripod assembly (3) is arranged on the telescopic structure (101); the lighting assembly (2) is arranged on a telescopic end (1011) of the telescopic structure (101) and moves synchronously with the telescopic end (1011); and the storage structure (102) is arranged on a movement track of the lighting assembly (2) and provided with an inlet/outlet port (1021) allowing the entry and exit of the lighting assembly (2) into and from the storage structure (102),wherein the tripod assembly (3) comprises a tripod connecting member (301) arranged on the telescopic structure (101), and a plurality of supporting legs (302) arranged on the tripod connecting member (301);

the plurality of supporting legs (302) comprise at least one adjustable supporting leg (3021), the adjustable supporting leg (3021) being telescopic in a length direction thereof;

wherein the tripod connecting member (301) is slidably arranged on the telescopic structure (101), and the supporting legs (302) are rotatably arranged on the tripod connecting member (301); when the tripod connecting member (301) slides relative to the telescopic structure (101), the supporting legs (302) are driven to rotate so that the supporting legs (302) move close to and away from each other; and the tripod assembly (3) comprises a slidable positioning structure (303) for slidably positioning the tripod connecting member (301); the slidable positioning structure (303) comprises a positioning column (3031), and an operating member (3032) for driving the positioning column (3031) to move close to and away from the telescopic structure (101); the telescopic structure (101) is provided with a positioning hole (3033) matching the positioning column (3031); the tripod assembly (3) further comprises a slidable positioning elastic member (3034) acting on the positioning column (3031) so that the positioning column has a tendency to move toward the telescopic structure (101).

2. The tripod lamp according to claim 1, wherein the storage structure (102) is arranged on one side of the lighting assembly (2) and located on one side, in a retraction direction, of the telescopic end (1011).

3. The tripod lamp according to claim 1, wherein the lighting assembly (2) comprises a lamp holder (201) connected to the telescopic end (1011), and a lamp body (202) arranged on the lamp holder (201);

the lamp holder (201) is rotatably arranged on the telescopic end (1011), and a rotating shaft of the lamp holder (201) rotating relative to the telescopic end (1011) is perpendicular to a telescoping direction of the telescopic structure (101);

the lamp body (202) is rotatably arranged on the lamp holder (201), and a rotating shaft of the lamp body (202) rotating relative to the lamp holder (201) is perpendicular to the rotating shaft of the lamp holder (201) rotating relative to the telescopic end (1011).

4. The tripod lamp according to claim 3, wherein a plurality of lamp bodies (202) are arranged.

5. The tripod lamp according to claim 1, wherein the telescopic structure (101) is a telescopic rod structure, comprising a first telescopic rod (1014), a second telescopic rod (1015) sheathed outside the first telescopic rod (1014), and a telescopic seat (1016) sheathed outside the second telescopic rod (1015);

the telescoping structure (101) comprises a locking structure (1017), the locking structure (1017) acting on the first telescoping rod (1014) to allow or limit axial movement of the first telescoping rod (1014) relative to the second telescoping rod (1015) and acting on the second telescoping rod (1015) to allow or limit axial movement of the second telescoping rod (1015) relative to the telescoping seat (1016).

6. A tripod lamp comprising: a bracket assembly (1), a lighting assembly (2) for lighting, and a tripod assembly (3) for supporting standing, wherein the bracket assembly (1) comprises a telescopic structure (101), and a storage structure (102) matching the lighting assembly (2) for storing the lighting assembly (2); the tripod assembly (3) is arranged on the telescopic structure (101); the lighting assembly (2) is arranged on a telescopic end (1011) of the telescopic structure (101) and moves synchronously with the telescopic end (1011); and the storage structure (102) is arranged on a movement track of the lighting assembly (2) and provided with an inlet/outlet port (1021) allowing the entry and exit of the lighting assembly (2) into and from the storage structure (102), wherein the lighting assembly (2) comprises a lamp holder (201) connected to the telescopic end (1011), and a lamp body (202) arranged on the lamp holder (201);

the lamp holder (201) is rotatably arranged on the telescopic end (1011), and a rotating shaft of the lamp holder (201) rotating relative to the telescopic end (1011) is perpendicular to a telescoping direction of the telescopic structure (101);

the lamp body (202) is rotatably arranged on the lamp holder (201), and a rotating shaft of the lamp body (202) rotating relative to the lamp holder (201) is perpendicular to the rotating shaft of the lamp holder (201) rotating relative to the telescopic end (1011);

wherein a lamp holder rotating shaft (1012) is arranged on the telescopic end (1011), the lamp holder (201) is rotatably arranged on the telescopic end (1011) by means of the lamp holder rotating shaft (1012), and the lamp holder (201) is rotatably arranged relative to the lamp holder rotating shaft (1012); a lamp holder positioning portion (1013) is arranged on the lamp holder rotating shaft (1012), and a positioning groove (1013*a*) is provided on a side wall of the lamp holder positioning portion (1013); the lamp holder (201) is provided with a lamp holder positioning member (2011), and a lamp holder positioning elastic member (2012) acting on the lamp holder positioning member (2011) so that the lamp holder positioning member has a tendency to move toward the side wall of the lamp holder positioning portion (1013); an end of the lamp holder positioning member (2011) facing the lamp holder positioning portion is provided with a lamp holder positioning protrusion (2011*a*) matching the positioning groove (1013*a*);

a side wall of the positioning groove (1013*a*) of the lamp holder (201) and/or a side wall of the lamp holder positioning protrusion (2011*a*) is provided with a first guide slope (5) for guiding the lamp holder positioning member (2011) to move in a direction away from the side wall of the lamp holder positioning portion (1013).

7. A tripod lamp, comprising: a bracket assembly (1), a lighting assembly (2) for lighting, and a tripod assembly (3) for supporting standing, wherein the bracket assembly (1) comprises a telescopic structure (101), and a storage structure (102) matching the lighting assembly (2) for storing the lighting assembly (2); the tripod assembly (3) is arranged on the telescopic structure (101); the lighting assembly (2) is arranged on a telescopic end (1011) of the telescopic structure (101) and moves synchronously with the telescopic end (1011); and the storage structure (102) is arranged on a movement track of the lighting assembly (2) and provided with an inlet/outlet port (1021) allowing the entry and exit of the lighting assembly (2) into and from the storage structure (102), wherein the lighting assembly (2) comprises a lamp holder (201) connected to the telescopic end (1011), and a lamp body (202) arranged on the lamp holder (201);

the lamp holder (201) is rotatably arranged on the telescopic end (1011), and a rotating shaft of the lamp holder (201) rotating relative to the telescopic end (1011) is perpendicular to a telescoping direction of the telescopic structure (101);

the lamp body (202) is rotatably arranged on the lamp holder (201), and a rotating shaft of the lamp body (202) rotating relative to the lamp holder (201) is perpendicular to the rotating shaft of the lamp holder (201) rotating relative to the telescopic end (1011);

wherein a lamp holder rotating shaft (2021) is arranged on the lamp body (202), and the lamp body (202) is drivingly arranged on the lamp holder (201) by means of the lamp body rotating shaft (2021); the lamp body rotating shaft (2021) is provided with a first lamp body positioning gear (2022) rotating synchronously therewith; the lamp holder (201) is provided with a second lamp body positioning gear (2013) matching the first lamp body positioning gear (2022), and a lamp body positioning elastic member (2014) acting on the second lamp body positioning gear (2013) so that the second lamp body positioning gear has a tendency to move toward the first lamp body positioning gear (2022); the second positioning gear is limited to rotate relative to the lamp holder (201); a side of the first lamp body positioning gear (2022) facing the second lamp body positioning gear (2013) is provided with a first lamp body positioning tooth surface (2022*a*); and a side of the second lamp body positioning gear (2013) facing the first lamp body positioning gear (2022) is provided with a second lamp body positioning tooth surface (2013*a*) matching the first lamp body positioning tooth surface (2022*a*).

8. A tripod lamp, comprising: a bracket assembly (1), a lighting assembly (2) for lighting, and a tripod assembly (3) for supporting standing, wherein the bracket assembly (1) comprises a telescopic structure (101), and a storage structure (102) matching the lighting assembly (2) for storing the lighting assembly (2); the tripod assembly (3) is arranged on the telescopic structure (101); the lighting assembly (2) is arranged on a telescopic end (1011) of the telescopic structure (101) and moves synchronously with the telescopic end (1011); and the storage structure (102) is arranged on a movement track of the lighting assembly (2) and provided with an inlet/outlet port (1021) allowing the entry and exit of the lighting assembly (2) into and from the storage structure (102), comprising: a cover plate (4) for covering the inlet/outlet port (1021), wherein the cover plate (4) is movably arranged on the storage structure (102);

the storage structure (102) is provided with a first holding portion (1022) for holding the cover plate (4) to cover the inlet/outlet port (1021), and a second holding portion (1023) for holding the cover plate (4) to uncover the inlet/outlet port (1021).

* * * * *